United States Patent [19]

Lefebvre

[11] 4,172,489

[45] Oct. 30, 1979

[54] DISTRIBUTION BOX FOR LOW-PRESSURE CASTING OF FOUNDRY PIECES

[75] Inventor: Jean-Henri Lefebvre, Chaville, France

[73] Assignee: Regie Nationale des Usines Renault, Billancourt, France

[21] Appl. No.: 837,403

[22] Filed: Sep. 28, 1977

[30] Foreign Application Priority Data

Sep. 28, 1976 [FR] France ..... 76 29081

[51] Int. Cl.[2] ..... B22D 17/06; B22D 17/30

[52] U.S. Cl. ..... 164/309; 164/119; 164/135; 164/259

[58] Field of Search ..... 164/113, 119, 129, 131, 164/133, 135, 136, 303, 306, 309–311, 316, 337, 343–347

[56] References Cited

U.S. PATENT DOCUMENTS

| | | | |
|---|---|---|---|
| 3,076,070 | 2/1978 | Lefebvre et al. | 164/303 |
| 3,672,437 | 6/1972 | Bennett | 164/303 X |
| 3,698,471 | 10/1972 | Chatourel et al. | 164/113 X |
| 3,727,674 | 4/1973 | Chatourel et al. | 164/306 |

FOREIGN PATENT DOCUMENTS

| | | | |
|---|---|---|---|
| 2287294 | 5/1976 | France | 164/303 |
| 2355588 | 1/1978 | France | 164/350 |

OTHER PUBLICATIONS

German Journal "Giesserei", Nov. 16, 1972, No. 23, pp. 681–686.

*Primary Examiner*—Othell M. Simpson
*Assistant Examiner*—Gus T. Hampilos
*Attorney, Agent, or Firm*—Oblon, Fisher, Spivak, McClelland & Maier

[57] ABSTRACT

An arrangement for casting foundry pieces comprising a source of liquid metal under low pressure in the form of a pressurized furnace, a column of metal or any other arrangement feeding a metal-distributing chamber connected to the mold cavities by gates, the distribution chamber being vertical and parallel to the faces of the pieces being cast, the gates running horizontally from the chamber to the mold cavities and transmitting the pressure of the metal in the chamber to the castings during solidification after filling of the mold cavities.

7 Claims, 22 Drawing Figures

DISTRIBUTION BOX FOR LOW-PRESSURE CASTING OF FOUNDRY PIECES

BACKGROUND OF THE INVENTION

1. Field of the Invention

The present invention relates to an improvement in low-pressure casting techniques both in shell and in sand molds.

2. Brief Description of the Prior Art

It is known that large-area pieces of heterogeneous constitution can be cast by pouring through multiple gates leading from a distribution chamber, which may be heated, being situated below the mold cavity. This arrangement is mainly reserved for uncored pieces or for those the cores of which expose little surface area outside the castings. Such an arrangement is described in the French Pat. No. 2,287,294 in the name of the present applicant.

However, for the casting of heavily cored pieces in shells, where a large quantity of sand is present around the castings, as well as in the case of pieces cast in molds entirely of sand, it is desirable to avoid this arrangemment, since grains of sand can fall into the distribution chamber through the gates. The result is inclusions which lower the quality of the castings.

SUMMARY OF THE INVENTION

An object of the present invention is therefore to provide a casting arrangement, particularly for low-pressure casting of cored pieces in shells, as well as in sand molds, which avoids the drawback noted for heavily cored pieces by adopting a different idea for the distribution chamber, such not being placed directly under the mold cavity, as in the cited French patent application.

In the case of shell-casting at low pressure, such an arrangement comprising a furnace feeding a shell mold by pouring liquid metal through a tube leading into a distribution chamber, connected by gates to the mold cavities, is essentially characterized, according to a preferred embodiment of the present invention, by the fact that the mold is situated in a horizontal press with its parting planes vertical, a distribution chamber being disposed vertically between the plates of the horizontal press and against the wall of the mold that it feeds. A vertical press with a laterally moving mold can likewise be used.

One arrangement, in particular, which achieves the object of the present invention, relates to the fabrication of cylinder heads for motors or of complex pieces calling for very delicate coring, and especially cores made by a procedure of hardening sand in a cold box where there is a possibility of large distortions because of the plasticity of the binder when hot. In this case, it is necessary to avoid any force due to the pressure of the metal on the cores and to get as much gas as possible out of the core.

A casting arrangement which satisfies the above requirements is characterized by the fact that the molds are disposed in such a way on opposite sides of the distribution chamber that the pieces being cast are vertical, one end of a piece resting on the bottom of a mold shell.

It will be noted that the act of passing from the pouring of two horizontal cylinder heads in the first embodiment to that of four vertical cylinder heads in the case of the latter arrangement does little to change the metal flow capacity between the distribution chamber and the mold cavities, since the number of gates per casting is about the same. The rate of rise of metal in the chamber should be proportional to the possibilities of flow for obtaining stage by stage filling.

The arrangements examined for cylinder heads are the same for crankcases, supports or any other parts of given surface area having a heterogeneity in mass, which requires the provision of liquid metal feeding at several points.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts throughout the several figures, and in which.

DETAILED DESCRIPTION OF THE ILLUSTRATED EMBODIMENTS

Figure 1:
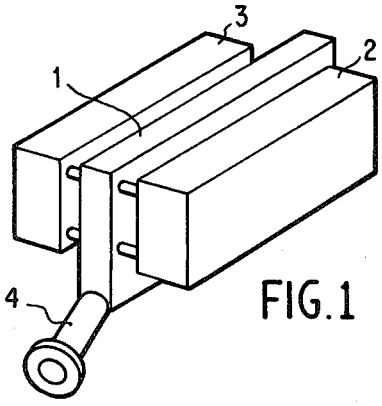
FIG. 1 is a perspective view of a mold for casting motor cylinder heads oriented on a face of very small dimensions, with its distribution chamber conforming to the invention.
Figure 2:
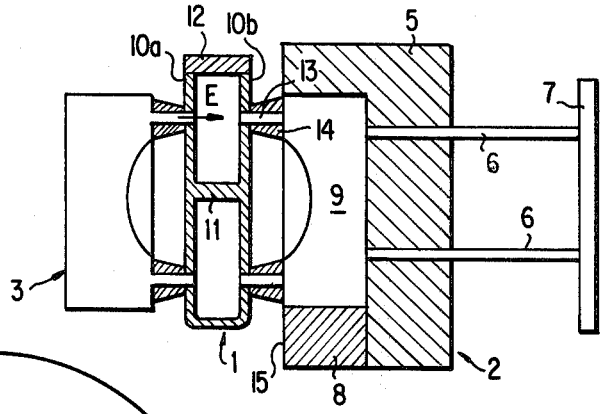
FIG. 2 is a vertical cross section of the mold of FIG. 1 with its ejectors being shown, to illustrate stripping of the castings from the mold.

Referring now to the Drawings, and more particularly to FIGS. 1 and 2, there is shown a distribution chamber 1 in the form of a flat box disposed vertically on a long edge thereof between two molds 2, 3 for casting two parts. A pouring tube 4 enters the chamber 1 at the bottom of one end to supply molten metal coming from a low-pressure furnace.

Each mold comprises a movable first part or half-shell 5 through which pass ejectors 6 activated by a mechanism indicated schematically at 7, and a part 8 of the second half-shell, which can be separated from the first. The castings 9 in the example are the heads of four-cylinder automobile engines.

The distribution chamber 1 is a one-piece casting of an alloy resistant to oxidation at heat, such as a refractory cast iron. The vertical sides 10*a*, 10*b* of the chamber are joined to one another by stiffening cross-pieces 11. The top of the chamber is closed by a cover 12 which allows access to the interior of the distribution chamber.

The gates 13 from the distribution chamber 1 are placed in sand reglets 14, the binder of which must be particularly resistant to heat, for example phenolic or furanic resins in furfurylic alcohol. The face of the cylinder head which is to be next to the combustion chambers of the motor is obtained by means of these reglets 14 and by shells chilled or not, which will be described in detail below, as well as by means of core blocks integral with the reglets 14 and which form the internal portions of the cylinder head, the reglet and block forming a strong rigid assembly easily remolded by a mechanical arrangement.

The gates located in the reglets can be provided with filters of glass wool or other material familiar in light-alloy casting. These reglets prevent accidental anchoring or sticking of these gates in the mold during solidification and, consequently, the risk of formation of fissures is reduced in assuming constant temperature in this critical zone of pouring.

Castings are stripped from the mold by the motion of the assembly 5, 6 and 8, after a certain displacement the portion 8 of the mold and the ejectors 6 stopping while the portion 5 of the mold continues its horizontal motion to release the casting.

The ejectors 6 then retract to their initial position in the portion 5 of the mold and the casting 9 is ready for removal by ejectors (not shown) in the portion 8 of the mold, which raise it vertically from the latter, and for extraction by mechanical means. If portions of the casting are in the lower portion of the plane 15, ejection in the direction of the arrow E may be necessary by means passing through the distribution chamber 1.

The above arrangement, then, only allows casting a single part at each pouring instead of two parts if this double ejection is not necessary.

A machine will now be described which permits the casting of two parts at each injection if no ejection is necessary for stripping the faces receiving the gates, or a single part when such ejection is necessary.

Figure 3:
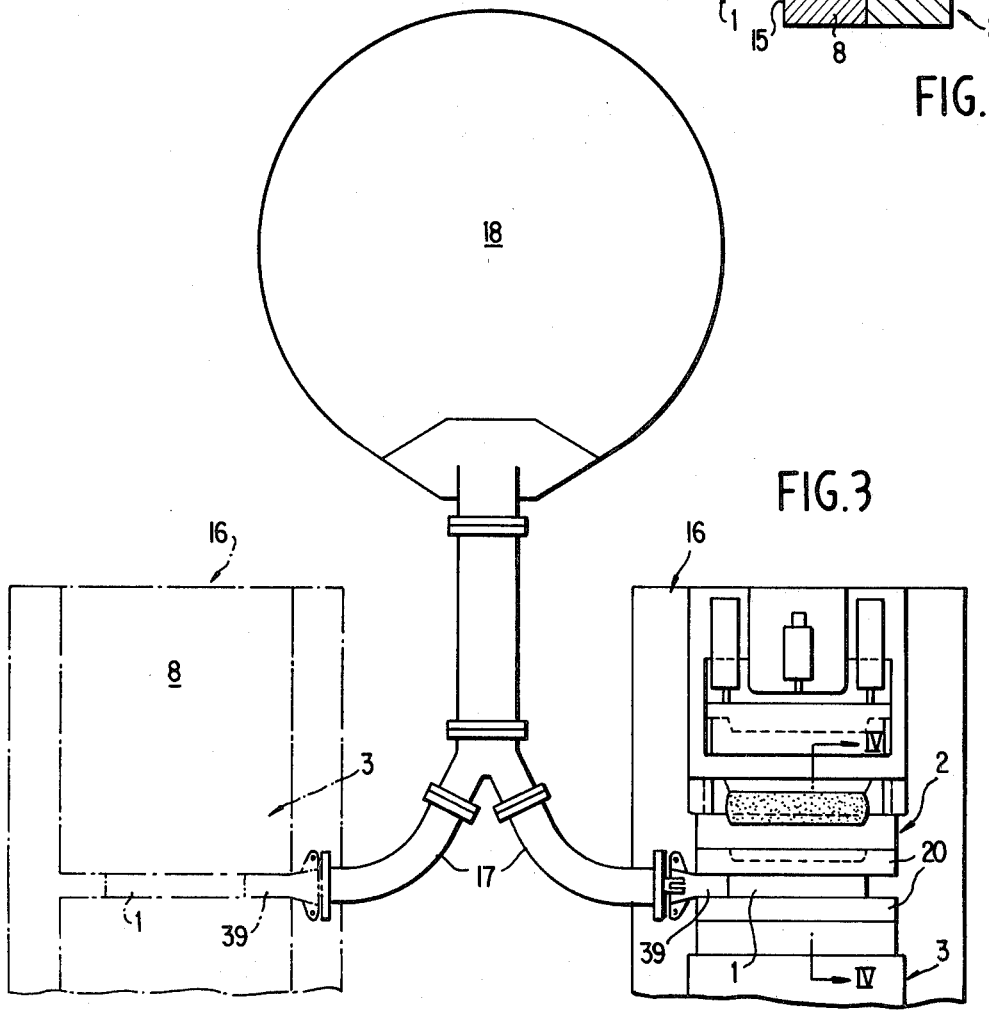
FIG. 3 is a plan view of an arrangment with two presses for castings cylinder heads or other complex parts where the parts are placed on one of their smallest dimension faces.

Such a machine, according to FIG. 3, comprises two horizontal presses 16 provided with vertical distribution chambers 1 and fed simultaneously by a Y-shaped pipe 17, connected to a low-pressure furnace 18, with radiant or induction heating, of appropriate capacity. Two vertical plates 20 of the press adjacent to shell molds 2, 3, as in FIG. 1, may enclose each distribution chamber 1, only one mold 2 being shown in its entirety in the drawing. The molds can be simple for casting two pieces, or double for casting four pieces, as has been mentioned previously.

Figure 4B:
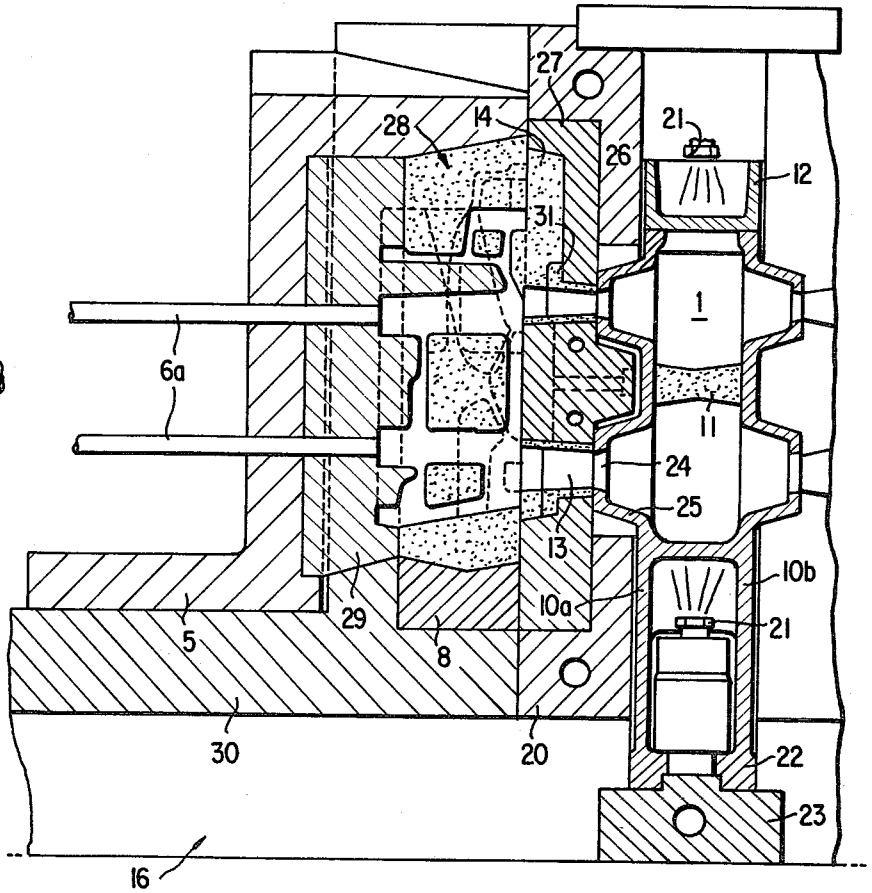
FIG. 4*b* is a sectional view taken along the line IV—IV in FIG. 3 in the case of parts cast on both sides of the chamber.
Figure 4A:
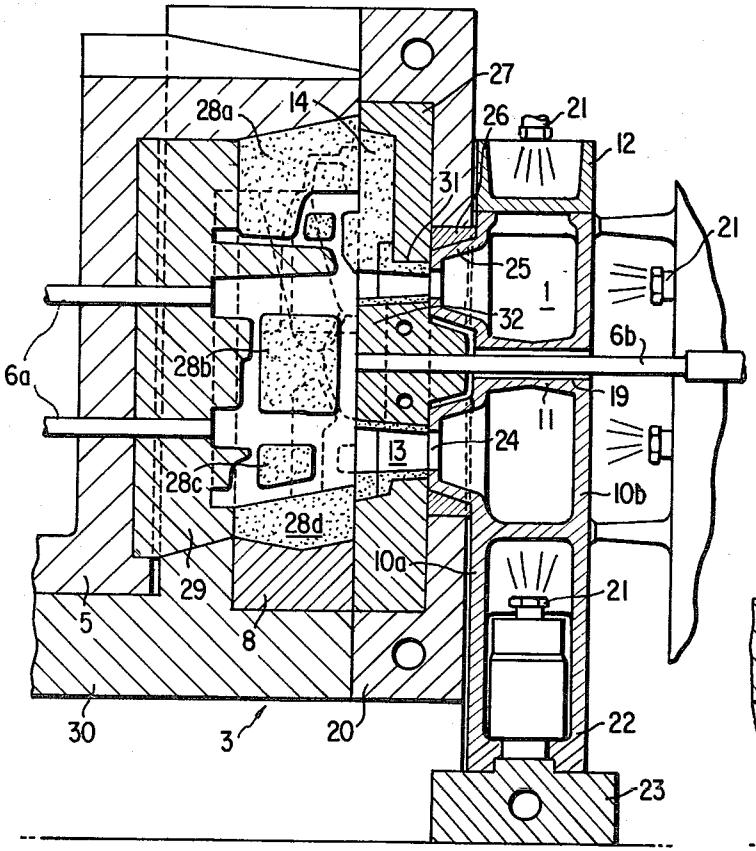
FIG. 4*a* is a sectional view taken along line IV—IV in FIG. 3 in the case of a single casting.

FIG. 4*a* illustrates the casting of a single part. Each vertical face of the mold 3 has ejectors. The face of the movable part 5 of the mold containing a part 29 of the shell is traversed by two ejectors 6*a* disposed horizontally and the face of the fixed part 27 of the shell is traversed by ejectors which pass through the stiffening cross-pieces 11 of the chamber 1 by way of borings 19 made for this purpose. The chamber 1 is heated by spaced burners 21 carried on its cover 12, inside its bottom plate 22 mounted on a base 23, and along its vertical face 10*b*.

The fixed vertical plate 20 of the press 16 is traversed by the outlets 24 of the gates from the chamber 1 which are formed in conical bosses 25 on the chamber, being insulated at 26. Inside this plate 20, there are a first metallic half-shell 27 and a core-sand reglet 14 on which are mounted the different core elements 28*a*, 28*b*, 28*c*, 28*d*, forming the contours of the cylinder head casting and located in the immovable part 8 of the second half-shell contained in the movable part 5 of the mold, likewise carrying another part 29 of the half-shell with the prints and placed on the movable horizontal plate 30 of the press 16.

In the half-shell 27 are the orifices of the gates 13 consisting of sand reglets 31. The orifices 13 likewise pass through the reglet 14.

Orifices 32 for cooling may also be provided in the half-shell 27.

The modified embodiment shown in FIG. 4*b* shows the case of castings requiring ejection from only one side. Again there is a distribution chamber 1, but one with bosses 25 having gate outlets 24 on both vertical faces 10*a* and 10*b*. Only ejectors 6*a* pass through the part 5–29 of the mold placed on the plate 30 of the press 16. The heater burners 21 for chamber 1 are distributed only along the cover 12 and in the bottom plate 22.

Figure 5:
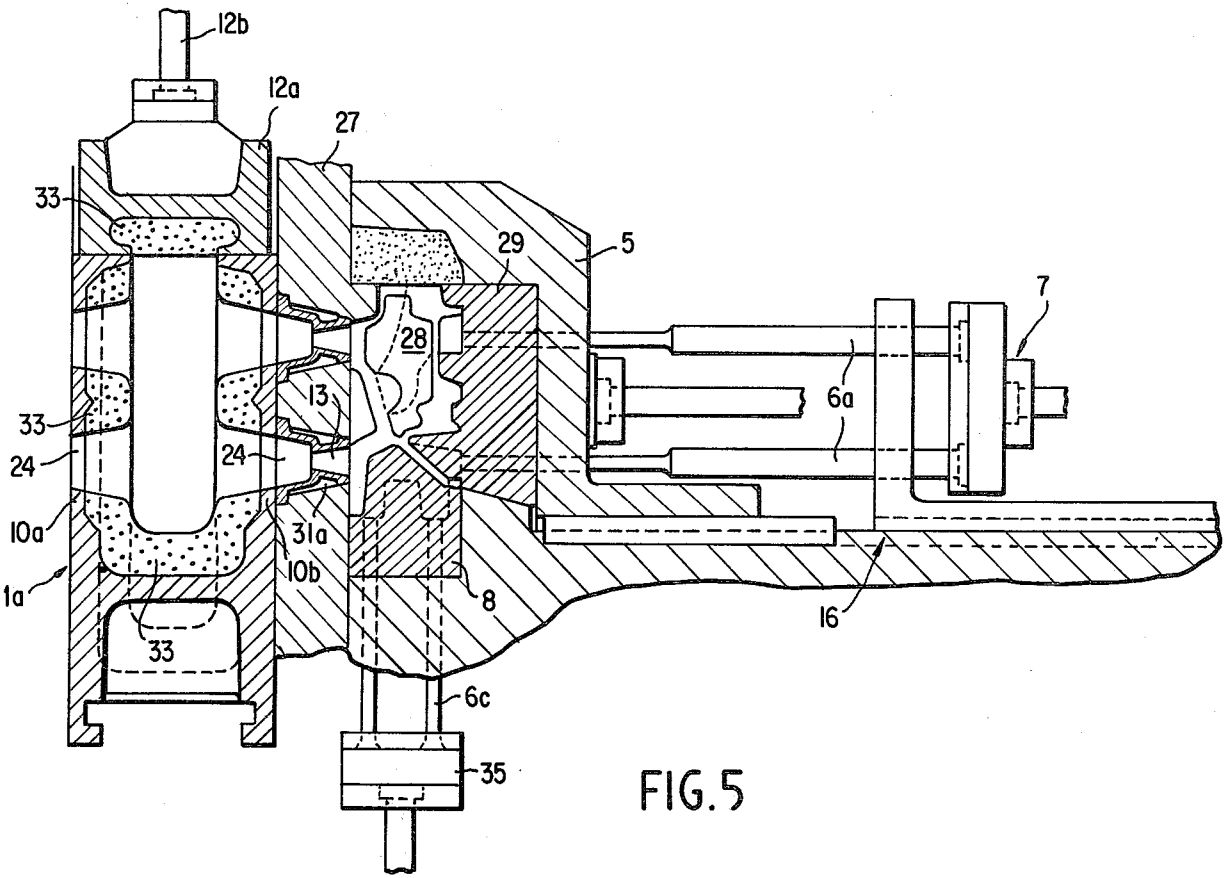
FIG. 5 shows a sectional view taken along the line IV—IV in FIG. 3 of a casting arrangement with an insulated distribution chamber.

FIG. 5 shows an embodiment of a modification of FIG. 4*b*, with a distribution chamber 1*a* being insulated by the technique of the aforementioned French Pat. No. 2,287,294.

This chamber 1*a* is lined on the insides of its vertical walls 9, 10, its bottom and its cover 12*a*, with an insulating refractory material 33 which also surrounds the conical pouring outlets 24 which lead into the gate orifices 13 formed in the castings as sleeves 31*a* which traverse the half-shell 27. These sleeves terminate in a conical section opening out towards the prints in the part 8 of the mold and forming the injectors of the gates 13. A cover closer 12*b* permits rapid access to the interior of the chamber.

As in the case of FIG. 2, the mold comprises a movable element 5 containing the part 29 of the half-shell and traversed by the ejectors 6*a* controlled by a mechanism 7 of the horizontal press 16, and a second movable element 8 containing the ejectors 6*c* which can lift the casting vertically for removal by means of a suitable mechanical arrangement 35 after horizontal displacement of part 5 of the mold. The bosses 25 of the chamber and the sleeves 31 of FIGS. 4*a* and 4*b* are replaced here by metallic sleeves 31*a* which form the gate 13 and are fixed on the walls 10*a* and 10*b* of the chamber 1*a* fitting into suitable openings in the part 27 of the shell.

Figure 6:
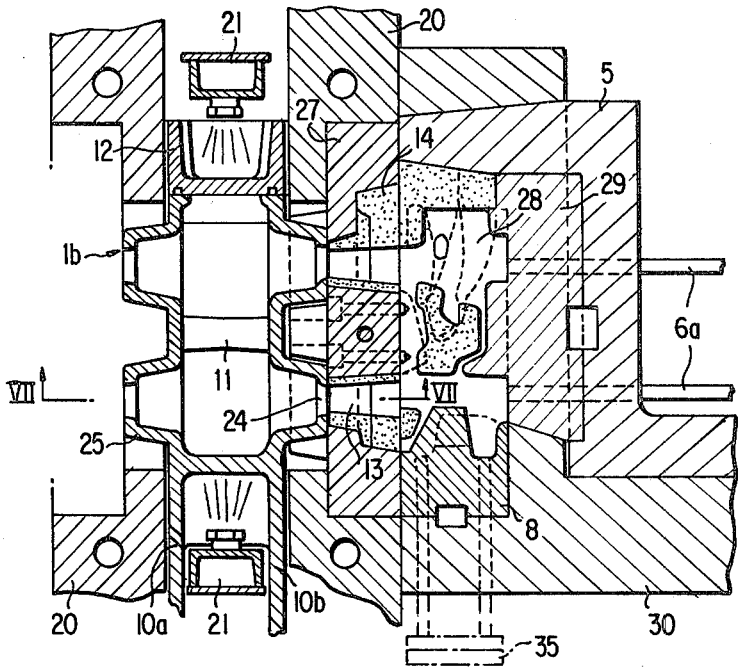
FIG. 6 shows the same view as seen in FIG. 5, of a casting arrangement with an uninsulated distribution chamber and with several feed points for the mold.

FIG. 6 shows another embodiment, a modified version of that shown in 4*b* having a vertical distribution chamber 1*b* which is uninsulated and has gates at many points. Two molds are situated in the horizontal press, one on each side of the distribution chamber 1*b*, only a single mold being shown in the drawing. Just about the same elements are found here, namely a chamber 1*b*, conical bosses 25 on the chamber, vertical plates 20, mold sections 5, 8, first half-shell 27, 29, core elements 28, gates 13, horizontal ejectors 6*a*, vertical ejectors 6*c* and upper and lower burners 21.

Figure 7:
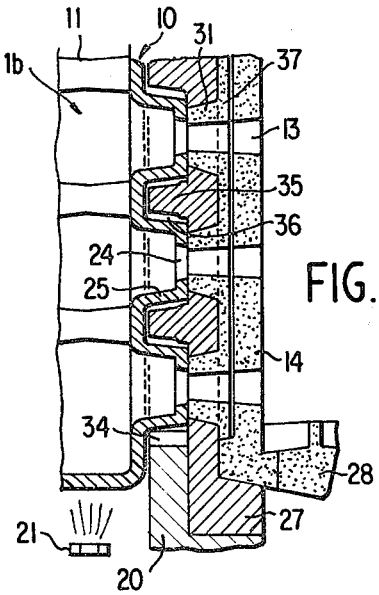
FIG. 7 is a sectional view taken through a horizontal plane along line VII—VII in FIG. 6.
Figure 8A:
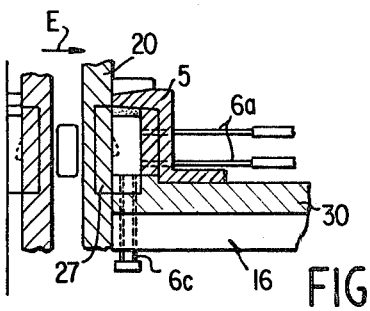
FIGS. 8*a*, 8*b*, 8*c* and 8*d* show a stripping sequence in the arrangement of FIG. 6.
Figure 8B:
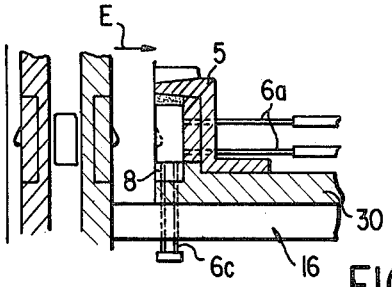
Figure 8C:
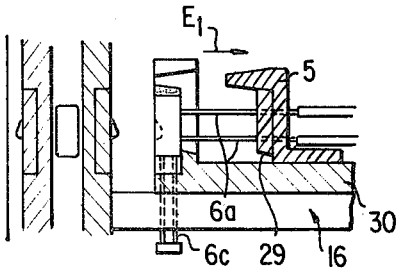
Figure 8D:
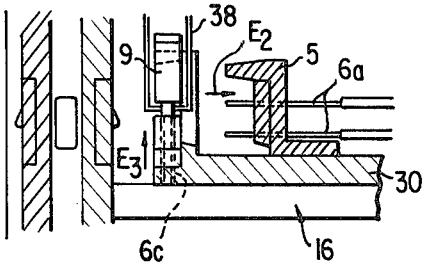

In FIG. 7, it is seen that the vertical chamber 1*b* enclosed by the vertical plates 20 of the press 16 is traversed longitudinally by stiffening cross-pieces 11 and exhibits on each side, in this direction, a number of conical bosses 25 situated between the cross-pieces 11 and traversed by the outlets 24 of the corresponding gates. The bosses 25 protrude into openings 34 in the vertical plate 20, inside which is placed the half-shell 27, the outer face of which is flush with the ends of the bosses and exhibits in its turn external ribs 35 which protrude into the openings 36 between the chamber bosses 25. The half-shell 27 also has openings therein into which are inserted sleeves or sand bosses 31, combined into a single assembly 37, and exhibiting passages forming the gates 13 made in the sand reglet 14 integral with the assembly 37 to which are attached the core elements 28. Burners 21 likewise are disposed at the two longitudinal extremities of the chamber 1*b*.

FIG. 8 illustrates schematically a stripping sequence for the mold of FIGS. 6 and 7. In a first step (*a*), the movable part 5 of the mold rests against the fixed plate 20. A pull in the direction of the arrow E is about to be applied to the movable part 5 of the mold. In step (*b*) the plate 30 of the press is displaced along with the ejectors 6*a* and 6*c* and with the two movable parts 5 and 8 of the mold which pull away from the fixed plate 20. In step (*c*), only the movable parts 5 of the mold continues to travel in the sense of arrow E, the ejectors remaining motionless. In the last step (*d*), the horizontal ejectors 6*a* are retracted from part 8 of the mold in the direction of arrow $E_2$ and the vertical ejectors 6*c* are pushed into part 8 of the mold to raise the casting 9 vertically in the direction of arrow $E_3$, so that an extraction device 38 can then seize it.

Figure 9:
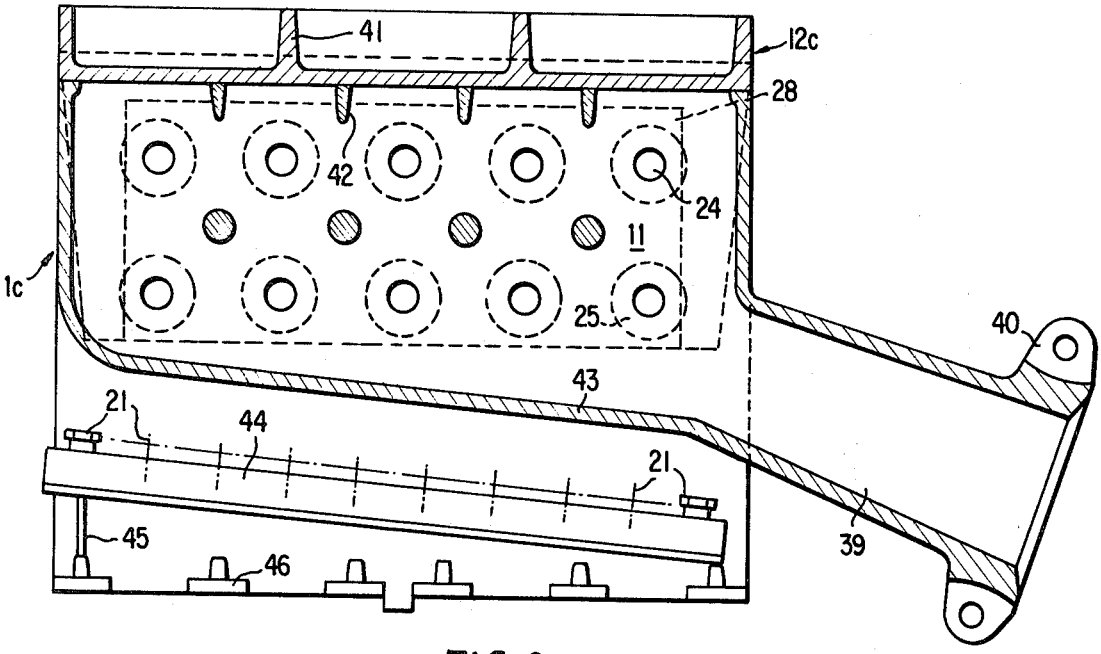
FIGS. 9 and 10 show vertical axial sectional views of two modes of realization of the distribution chamber with its cover and an internal ramp with gas burners for heating.

FIG. 9 shows a vertical longitudinal axial cross-section of a distribution chamber 1*c* exhibiting on each vertical face 10 two horizontal rows of bosses 25 with gate outlets 24. Between the two rows of bosses, there are stiffening cross-pieces 11 and at the bottom is a spout 39 with a flange 40 for connecting to the liquid metal feed pipe 17 of FIG. 3. A cover 12*c* with ribs 41 on top and ribs 42 on the bottom closes the top of the chamber 1*c*. Under the bottom 43 of the chamber 1*c* there are disposed, in an inclined ramp 44, gas burners 21 for heating the liquid metal fed to the chamber. Vertical supports 45 hold the ramp fixed to feet 46.

Figure 10:
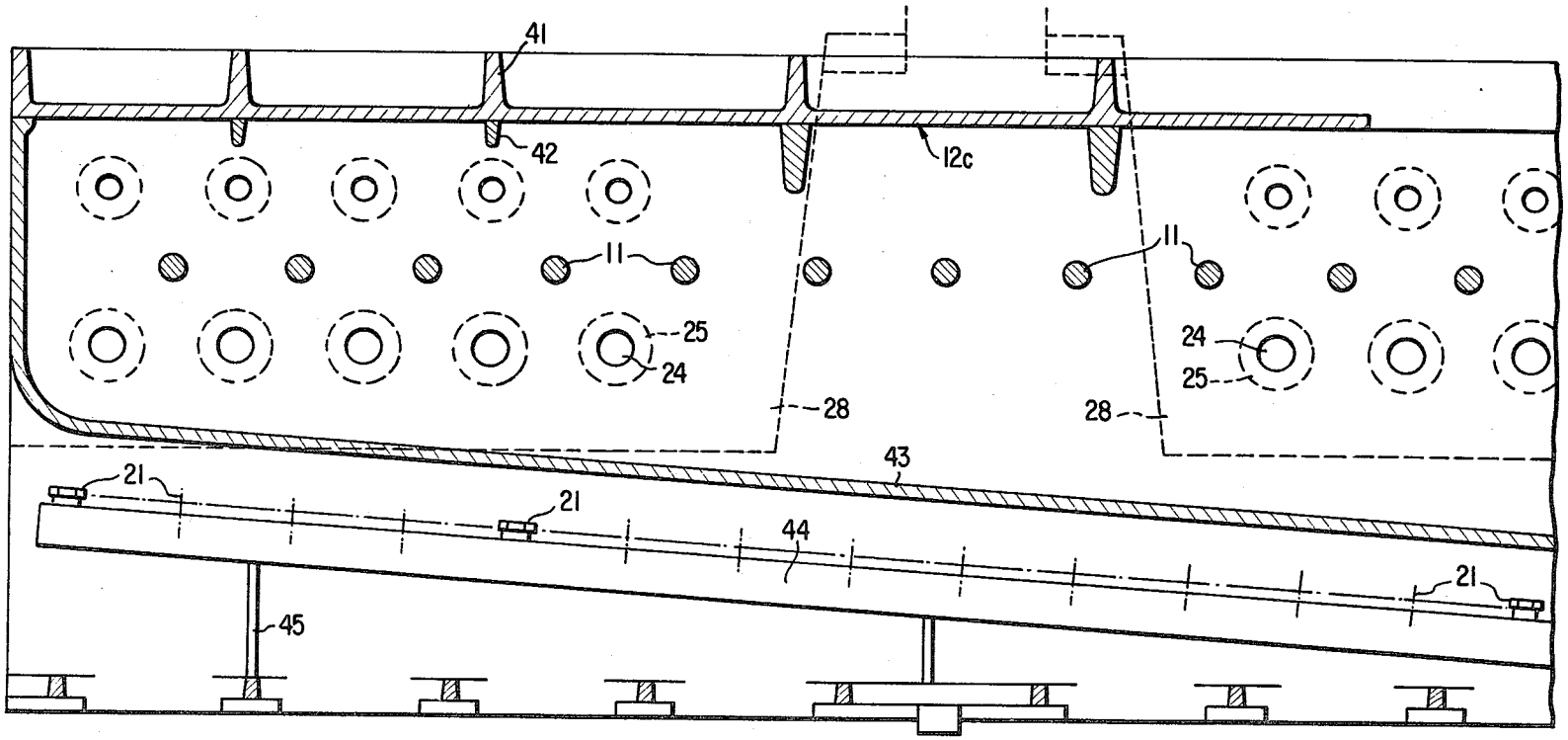
Figure 13:
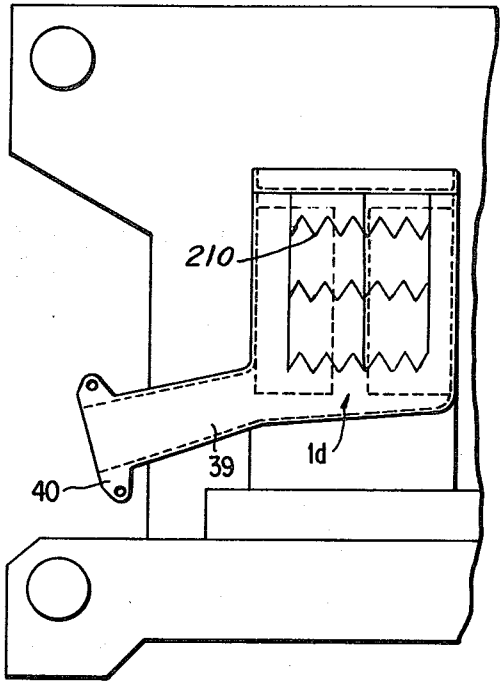
FIG. 13 is a side view of the casting chamber of FIG. 11.

FIG. 10 represents a chamber similar to that in FIG. 9, but more elongated in the longitudinal direction and exhibiting at least two rows of bosses 25 with gate outlets 24, permitting grouping several castings on each side of the chamber, placing in the molds a corresponding number of groupings 8 of cores 28.

The two rows of gates are separated by a space without gates, but in which the walls of the chamber are again connected by cross-pieces 11. An inclined ramp 44 with gas burners 21 spaced thereon is located under the bottom 43 of the chamber and mounted on supports 45 with feet 46.

Figure 11:
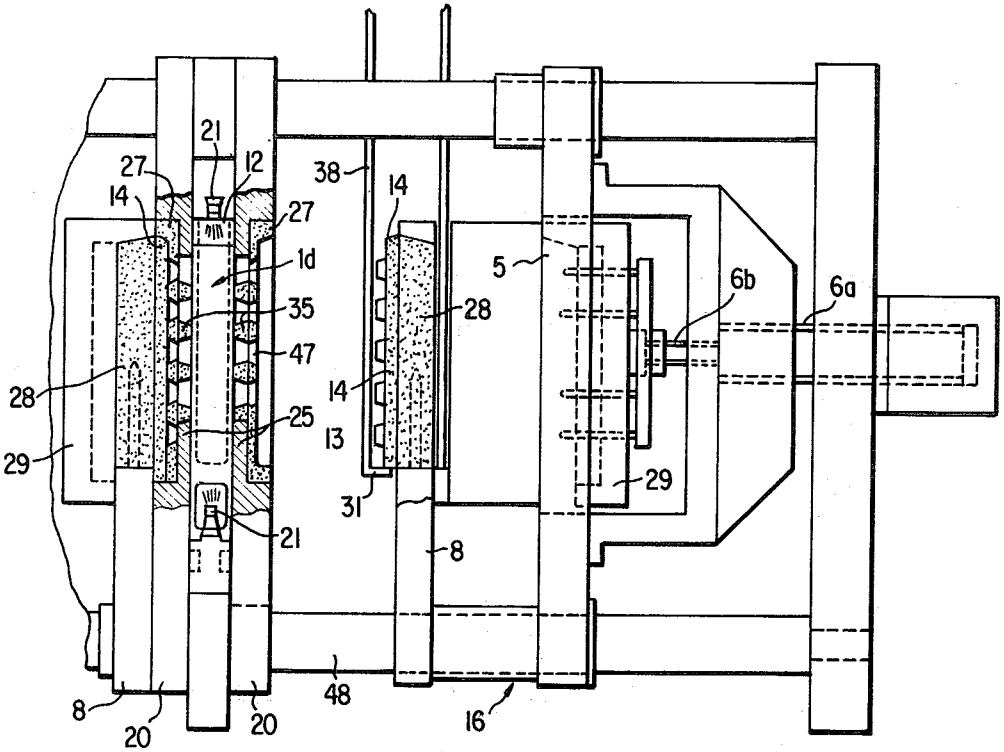
FIG. 11 shows a partial elevation view of a press with a coating arrangement with a partial vertical section of the molds, for pieces such as cylinder heads cast vertically by fours.
Figure 12:
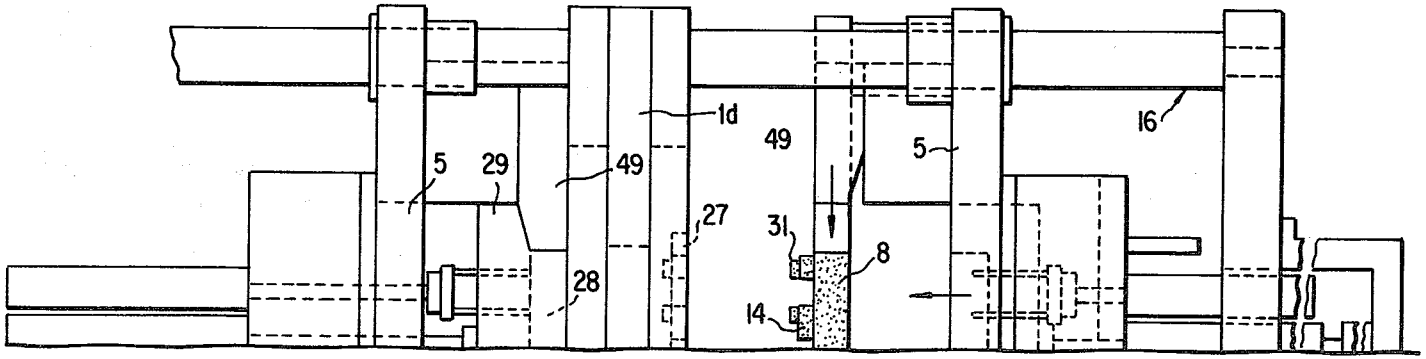
FIG. 12 is a plan view of half of the arrangement shown in FIG. 11, the other half being symmetric.
Figure 14:
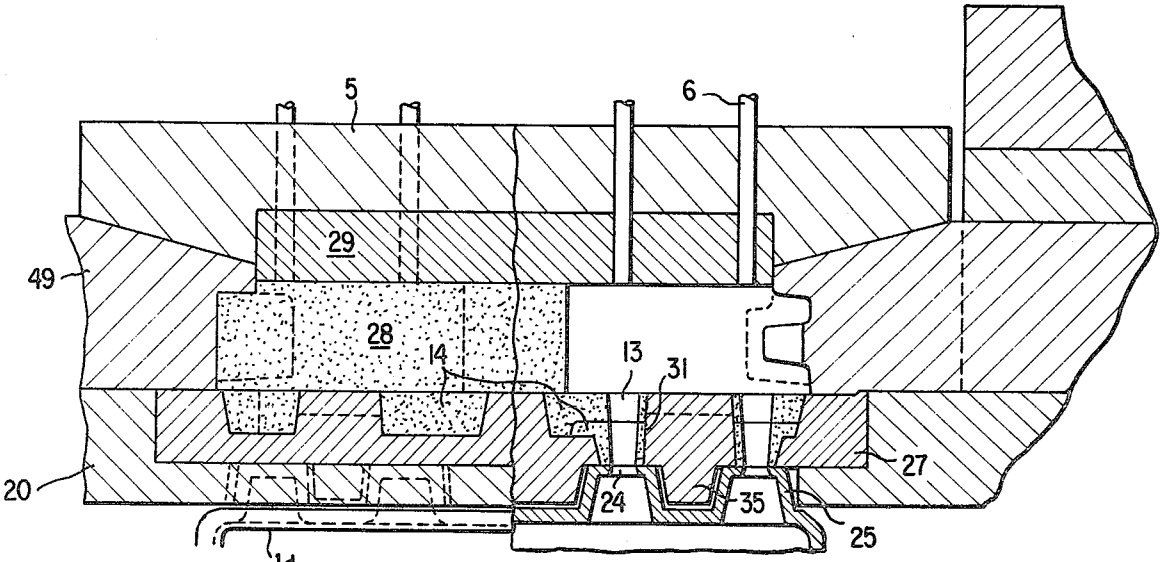
FIG. 14 shows a blow up of the details of the core assemblies of FIG. 11, the left of the drawing being in horizontal section through the reglet and the right being in section through the gates.

A final variant of the casting arrangement of the invention relates to the fabrication of cylinder heads or complex parts where the castings, as in FIGS. 11 to 14, are vertical, i.e., their narrow sides are at the bottom of the shell. The right hand parts of FIGS. 11 and 12 show the mold open and the left sides show the mold closed. It is seen that the distribution chamber 1*d* is of the same flat type as in the preceding examples, with a pouring spout 39 at the bottom connected by means of a flange 40 to the feed pipe 17 of FIG. 3.

The chamber is situated between two vertical plates 20 of the press 16 and exhibits on each side a set of bosses 25 (five rows high and two wide in the present example, for each casting) which protrude into the interior of plate 20 and rest against the half-shell 27 mounted inside the plate and having openings 47 for the gates into which fit the sleeves 31 of these gates 13, which are supported by the reglets 14. Ribs 35 increase the rigidity of the half-shells 27 and are held in corresponding grooves between the bosses 25 on the chamber 1*d*. To the reglets 14 are also attached the different cores 28 shaping the two castings. The reglets with the cores rest below on a movable part 8 of the shell which slides on the guides 48 of the press 16. A movable part 5 of the mold, which holds the shell 29 with the prints and the ejectors 6*a* and 6*c*, goes along with the shell 8. A mold element 49, moving horizontally, permits blocking the shell 29 when it makes contact with part 8 of the shell, the reglet 14 of which is to fit in the opening in shell 27.

After making the casting and opening the mold the part can be ejected vertically upwards, thanks to the special device 38 which can grip on the shell 8.

As in the preceding examples, there are transverse reinforcing cross-pieces 11 between the two vertical walls of the distribution chamber. For clarity of the drawing, however, these cross-pieces have not been shown.

The fact that one end of the casting is at the bottom of the shell permits regrouping two cores on a common support, thus decreasing the quantity of sand used for 28.

This arrangement permits casting four pieces at each injection, without this quantity being limiting, the number of castings depending on their design.

It is to be noted that the casting of four pieces in the case of horizontally placed cylinder heads is not really a good idea, by reason of the deformations possible in a passage of 1m to 1.5m, especially when it is heated.

The general idea of the distribution chamber does not change the heating which is always possible with peripheral burners 21.

However, the space between the two prints on the same side of the mold not corresponding to a pouring zone makes possible direct heating of the metal in the distribution chamber by a gas circulation loop or by submissible electrical resistors 210 attached to the cover 12 (see FIG. 13) which still allows access to the interior of the chamber 1*d*.

Figure 16:
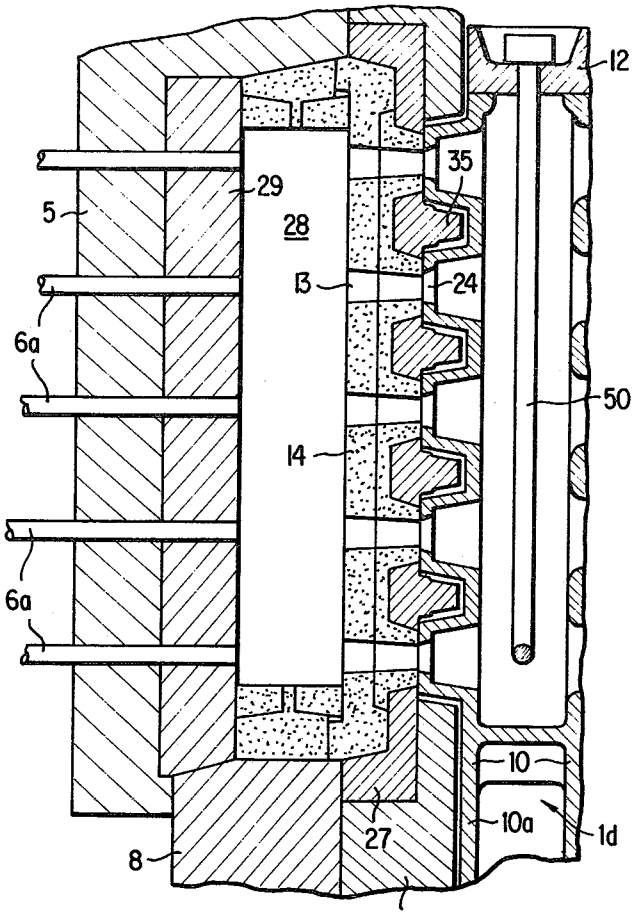
FIG. 16 is an enlarged sectional view of the distribution chamber with an electrical heating resistor dipping into the metal bath of the chamber.
Figure 15:
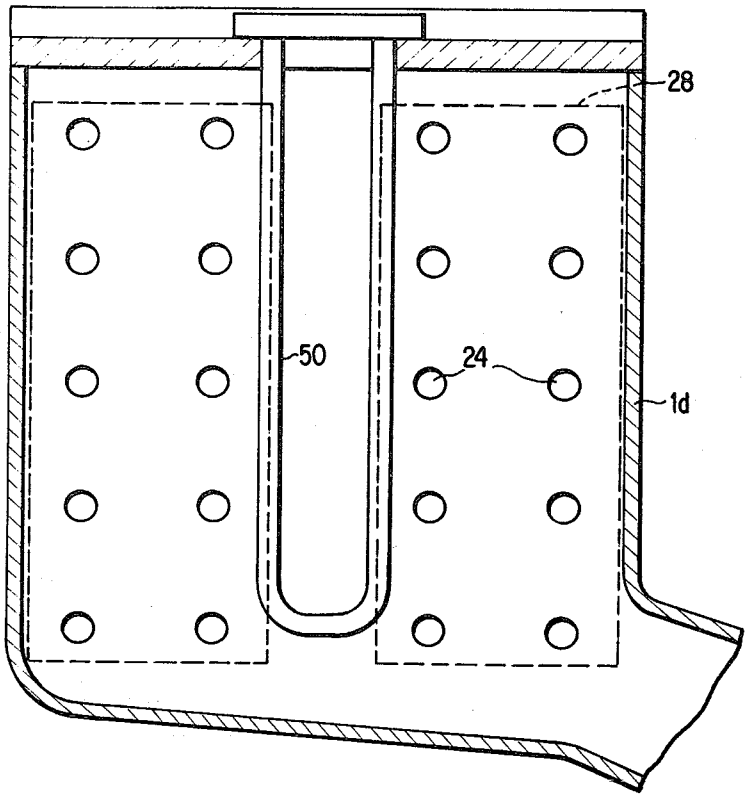
FIG. 15 shows a vertical longitudinal axial sectional view of the distribution chamber of FIGS. 11 to 13, provided with direct electrical heating.

Referring to FIGS. 15 and 16, it is seen that an electrical resistance heater loop 50 is submerged in the vertical longitudinal median plane inside the chamber 1*d*, the ends of the two arms of the loop being fastened to the cover 12 of the chamber. A connector box, not shown, is mounted on the cover. The resistance loop is situated in the center of the chamber and extends down to the level of the gate outlets 24 near the bottom of the chambers, with the aim of regulating the temperature of the metal during the pouring of the casting.

Of course, one could install, for this purpose, in place of the resistance loop, a tubular loop for circulation of a gas flame along the inner and outer walls of the chamber.

If an ejection is necessary to strip the face receiving the gates in the above arrangements for casting vertical pieces, one could cast two pieces only at each injection, as described above, for casting parts disposed horizontally in the mold with a vertical distribution chamber.

Figure 17:
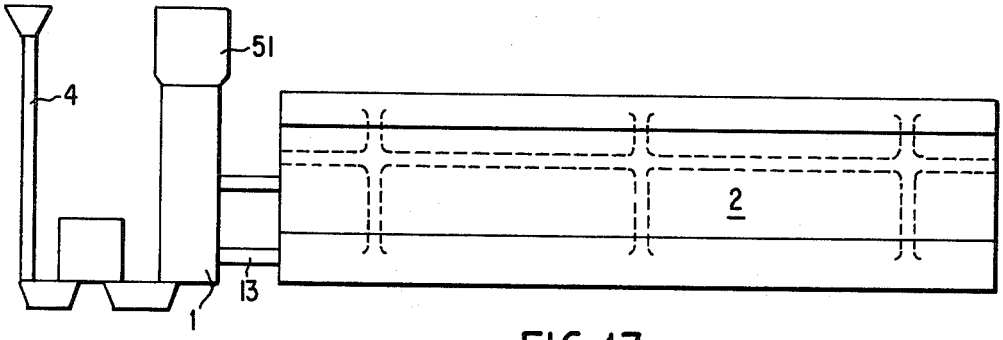
FIG. 17 shows an example of application of the casting system of the present invention, using a sand mold to cast a machine-tool bed.
Figure 18:
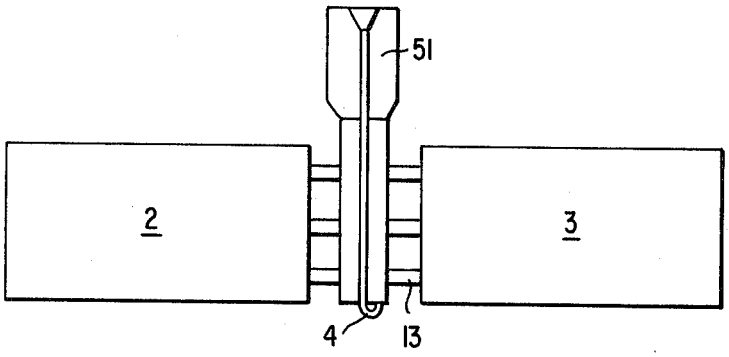
FIG. 18 shows the same application seen in FIG. 17 of a sand mold with two castings symmetrically disposed on the two sides of the distribution chamber.

The casting system of the invention can likewise be applied to molds entirely of sand. In this case, the distribution chamber situated in the sand mold can be difficult to maintain with liquid metal by heating, with the view of recovering the metal in this form. On the other hand the tooling investment is less and is better suited to production in small quantities, or even in individual pieces. The maintenance of the low pressure during solidification can be provided, in this case of sand molds, by liquid metal pressure columns such as those described in the French Pat. No. 2,355,588 in the name of the present applicant. FIGS. 17 and 18 show an example of application to the casting of items such as machine-tool beds.

FIG. 17 represents a mold 2 for a part such as a machine-tool bed, difficult to strip, with its distribution chamber 12, of design tailored to that of the casting, connected to the casting 2 by gates 13 and fed by a passage 4. One or more pressure columns 51 assure the maintenance at low pressure of the chamber 1 and the part in the mold 2 during its solidification.

FIG. 18 shows the same casting system schematically with two pieces in the molds 2 and 3, one on each side of the chamber 1, these constituting a sand-mold-casting variant of the system of FIG. 1 for casting in a shell mold. This arrangement has other advantages since the distribution chamber, heated more by the passage of metal feeding two castings instead of one, and maintained at temperature better between these two castings, is more effective in making up for their shrinkage in solidifying by reason of the increase in temperature gradients between the chamber and the castings.

Obviously many modifications and variations of the present invention are possible in light of the above teachings. It is to be understood therefore that within the scope of the appended claims this invention may be practiced otherwise than as specifically described herein.

What is claimed as new and desired to be secured by Letters of United States Patent is:

1. In an arrangement for casting foundry pieces comprising a furnace, at least one shell mold having a cavity, and a heated metal distribution chamber connected to said cavity by a plurality of gates, wherein liquid metal is supplied as a liquid metal column under low pressure from said furnace and is fed through said distribution chamber into said at least one shell mold, an improvement comprising:

said distribution chamber being in the form of a flat box internally reinforced by transverse cross-pieces joining the parallel side walls of said box, the top of said rod being closed by a cover;

said side walls of said box being disposed vertically and parallel to the faces of the castings of each said shell mold which receives said gates, said gates connecting said distribution chamber to the horizontal faces of each said mold cavities, wherein the pressure of the metal in said distribution chamber is transmitted to each said casting during their solidification after the filling of said molds; and said at least one mold being disposed in a horizontal press having horizontal plates and vertical parting planes, said heated distribution chamber being disposed vertically between said horizontal plates and against the wall of at least one said shell mold.

2. A casting arrangement according to claim 1, wherein said distribution chamber is of refactory cast iron which oxidizes little in flame.

3. A casting arrangement according to claim 1, wherein the outlets of said gates of said distribution chamber are disposed in conical bosses protruding into the part of said shell against which they rest.

4. A casting arrangement according to claim 3, further comprising electrical resistors attached to said cover, said electrical resistors being arranged to dip inside said distribution chamber down to the level of said gate outlets.

5. A casting arrangement according to claim 4, further comprising tubes for circulating hot gas fixed to said cover, said tubes being arranged to follow the inner and outer contours of said distribution chamber.

6. A casting arrangement according to claim 3, wherein a first part of said shell mold contains at least one reglet-base joined to a block of cores, said part of the shell mold resting, at its side opposite said reglet, against the bosses of the distribution chamber and exhibiting on this face ribs running between the bosses of said chamber.

7. A casting arrangement according to claim 6, wherein said gates passing therethrough, conical sleeves constituting the conduits of said gates.

* * * * *